US006092298A

United States Patent [19]

Salminen et al.

[11] Patent Number: 6,092,298

[45] Date of Patent: Jul. 25, 2000

[54] ARRANGEMENT FOR DRYING SECTION OF PAPER MACHINE

[75] Inventors: Ari Salminen, Kangasala; Kari Hyvönen, Tampere, both of Finland

[73] Assignee: Tamfelt Oyj ABP, Tampere, Finland

[21] Appl. No.: 09/325,626

[22] Filed: Jun. 4, 1999

[30] Foreign Application Priority Data

Jun. 5, 1998 [FI] Finland ..... 981289

[51] Int. Cl.[7] ..... F26B 13/26

[52] U.S. Cl. ..... 34/71; 34/95; 34/116; 162/902

[58] Field of Search ..... 34/71, 95, 116, 34/119, 123, 124; 162/902

[56] References Cited

U.S. PATENT DOCUMENTS

| | | | |
|---|---|---|---|
| 4,564,051 | 1/1986 | Odenthal | 139/425 A |
| 4,909,284 | 3/1990 | Kositzke | 139/383 A |
| 4,989,647 | 2/1991 | Marchand | 139/383 A |
| 5,778,555 | 7/1998 | Lehtinen et al. | 34/71 |
| 5,867,919 | 2/1999 | Retulainen | 34/71 |
| 6,009,634 | 1/2000 | Retulainen | 34/71 |

FOREIGN PATENT DOCUMENTS

| | | |
|---|---|---|
| 96790 | 8/1996 | Finland . |

*Primary Examiner*—Denise L. Ferensic
*Assistant Examiner*—Michelle A. Mattera
*Attorney, Agent, or Firm*—McDermott, Will & Emery

[57] ABSTRACT

The invention relates to an arrangement for a drying section of a paper machine, the arrangement comprising a fine wire (5*a*) and a coarse wire (5*b*) that are arranged to pass between metal bands (2, 3) of a band dryer (1) together with a web (4) to be dried. The coarse wire (5*b*) comprises a fine texture (5*d*) to be placed against the cooled metal band (3). Further, against the fine-textured section (5*d*) placed against the cooled metal band (3) there is a coarse texture (5*c*).

5 Claims, 4 Drawing Sheets

ARRANGEMENT FOR DRYING SECTION OF PAPER MACHINE

Figure 1:
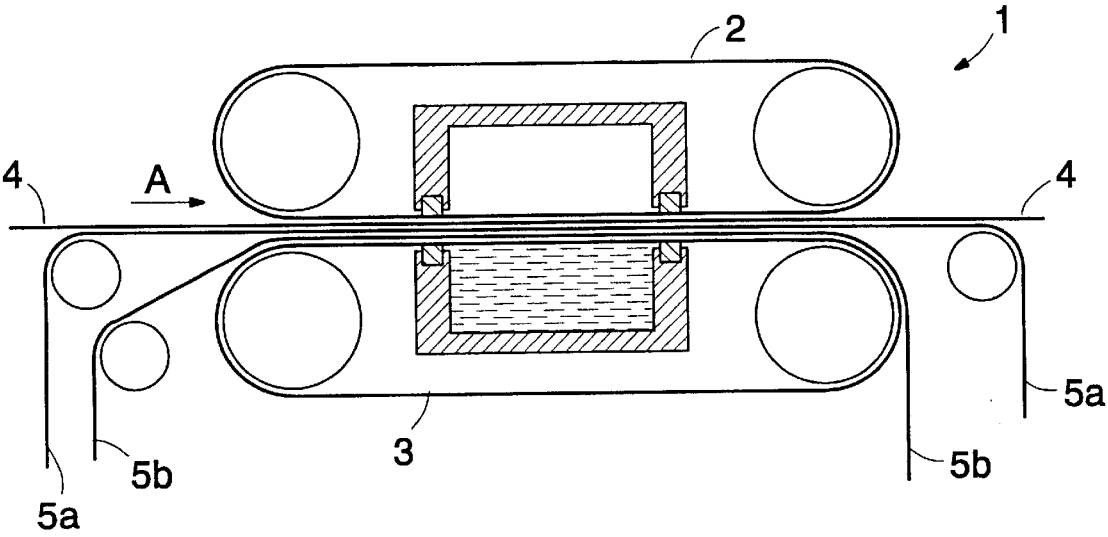

The invention relates to an arrangement for a drying section of a paper machine, the arrangement comprising a fine wire and a coarse wire which are formed of several threads and withstand high temperatures and humidity, the wires being arranged to pass through the drying section between a heated and a cooled metal band provided in the drying section, together with a fibre web placed against the heated band, such that the fine wire is arranged against the web to be dried and the coarse wire is arranged against the cooled metal band.

Paper machine fabrics, such as wires and felts, are used in different machines producing a web-like product from a pulp, such as paper machines, board machines or the like, which will be referred to herein as 'paper machines'. Paper machine fabrics are used at the wet end, the press section and the drying section of the paper machine for forming a web and guiding it via the different stages of the machine. At the beginning of the paper machine, a pulp is supplied to the wire for forming a web, and felts and wires are used in the press and drying sections of the machine. In the press section, water can be removed from the web when it is pressed for drying it before final drying by heat. When in use, paper machine fabrics rotate around different rolls and cylinders at a rate equal to that of the web.

A paper machine fabric is typically made of different threads of possibly varying cross-sections and materials in order to provide desired properties. Thread materials used include polyester, polyamide and other monofilament and multifilament threads. The manufacture of the fabrics employs different binding structures and combinations thereof, which should provide the fabric with desired properties suitable for the intended use. Dryer screens must operate under varying conditions, which means that sometimes they are subjected to heat and humidity and at other times to heat and drought. Further, a dryer screen is required to have good dimensional stability and durability as well as flexibility.

Typical paper machine fabrics include dryer screens used to guide the paper web to be dried through the drying section and to support the web so that the finished fibre web comprises as little marking as possible resulting from the texture of the wire, whereas the permeability and behaviour of the wire in the drying section is as desired. In dryer screens the object is to achieve as even and dense a surface structure as possible, in other words a high thread density, so that the web surface would be as smooth as possible. Usually the web is placed against the smoother surface of the dryer screen so that the occurrence of marking in the web can be prevented.

The drying of a fibre web may utilize a band dryer unit disclosed in Finnish Patent Application 944,775, wherein a fibre web is dried between two parallel metal bands moving in the same direction such that the web touches a heated metal band, and between the fibre web and the other, cooled metal band there is a wire so that as a result of heating the steam that evaporates from the fibre web is condensed in the wire due to the cold metal band. The wires may be bands made in the shape of a closed loop, or alternatively, bands that are connected together from their free ends to form a closed loop. A fibre web, a fine wire or fine felt and a coarse wire are carried between the upper band and the lower band through the drying section. The operation of the band dryer is based on the heating of the upper band that is in contact with the web, so that the water in the web evaporates due to the temperature of the upper band and it is transferred through the fine wire and the coarse wire towards the lower band. The lower band, in turn, is cooled so that steam produced on the surface of the band is condensed into water and it is discharged with the lower band and the coarse wire positioned against the lower band. The coarse wire preferably comprises a plurality of permeable flow conduits. Free flow in the direction of the wire level can be equal in all directions, or stronger in one direction, or the flow may be prevented in any direction, if required. Further, the coarse texture should have a sufficient water retention capacity. The coarse texture of the coarse wire situated against the cooled metal band is not always able to retain the water that is condensed on the side of the cooled metal band, as desired, but some of the water may be able to disadvantageously move back towards the web. This so-called rewetting naturally reduces the efficiency of the dryer and causes problems in the following stages of the paper machine.

The purpose of the present invention is to provide an arrangement for a drying section in a paper machine, avoiding the drawbacks of the prior art and enabling more efficient drying of a web than previously.

The arrangement according to the invention is characterized in that the side of the coarse wire to be placed against the cooled metal band has a fine texture, and that a coarse-textured section of the coarse wire is placed against said fine-textured section.

The basic idea of the invention is that between the web to be dried and the cooled metal band of the band dryer the arrangement comprises a fine wire placed against the web and a coarse wire provided against the metal band. The coarse wire comprises a section with a finer texture at least on one outer surface thereof, which is parallel to the direction of travel of the wire. It is essential that the section with a finer texture in the coarse wire is placed against the metal band unlike in previous solutions. When moving towards the web from the fine-textured section placed against the cooled metal band there is a section with a coarse texture that has good permeability. The essential idea of a preferred embodiment of the invention is that the coarse wire comprises a fine-textured section both on the surface against the metal band and on the surface against the fine wire, and that the texture of the section between these fine-textured sections is coarse. The basic idea of yet another preferred embodiment of the invention is that the fine-textured section of the coarse wire is formed by using in the wire surface layer thinner threads than in the coarse section of the wire and a binding structure providing a closer texture.

The invention has an advantage that the fine texture of the coarse wire placed against the cooled metal band is able to retain the water which has passed through the other sections of the coarse wire and which is condensed on the surface of the wire against the metal band, so that the liquid is no longer able to move from the coarse wire back to the web to wet it. In such a way, substantially all the liquid can be removed with the coarse wire, wherefore the removal of liquid from the web can be implemented in a controlled and efficient manner. The embodiment of the invention where both sides of the coarse wire are provided with fine-textured sections has an advantage that a smooth fine texture is also placed against the fine wire, thus further ensuring that substantially no marking occurs. Furthermore, the fine texture of the coarse wire against the fine wire wears the fine wire less than the coarse wire used in the prior solutions. The wearing caused by the movement of the fine wire and the coarse wire with respect to each other, for example the difference in speed between the wires, can be decreased by making the contacting surfaces of the wires smooth. The life of the wires can thus be increased, Further, the structure of the coarse wire according to the invention is stable.

Even though the terms 'coarse texture' and 'fine texture' are self-evident for a person skilled in the art, in the present application 'fine texture' refers to a layer with lower water or air permeability, a greater number of threads per surface area, or a layer with a greater contact area achieved with flatter threads than in the other layers of the fabric. A close fine texture may have all the aforementioned properties simultaneously. Such a dense layer can be made on the surface of the coarse wire in several different manners. It is possible to use either spun or doubled threads, threads with an oval or flat cross-section, or a lower thread density together with thicker threads, or a higher thread density and correspondingly thinner threads.

Figure 2:
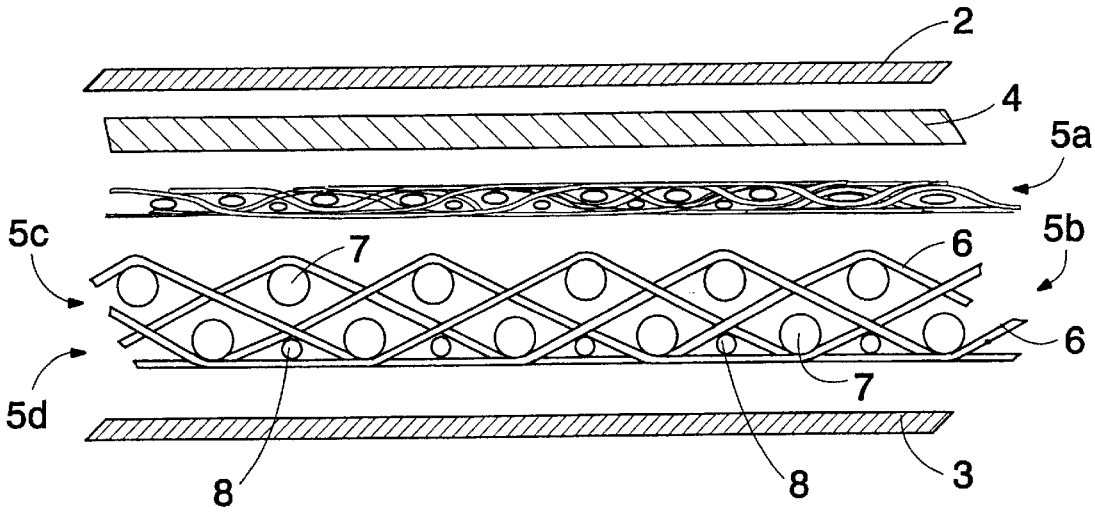
Figure 3A:
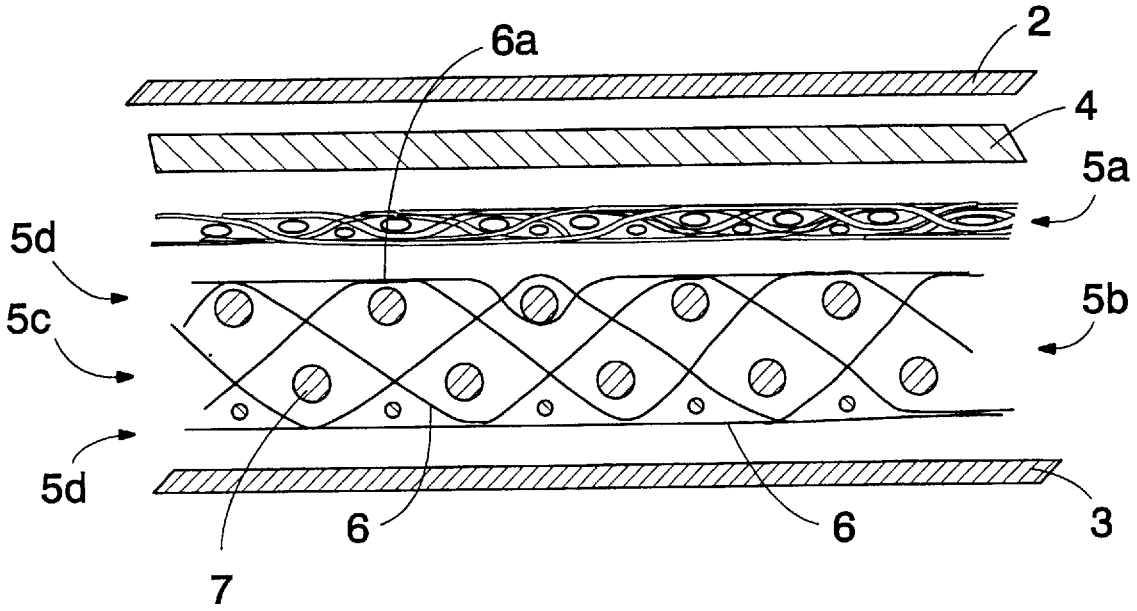
Figure 3B:
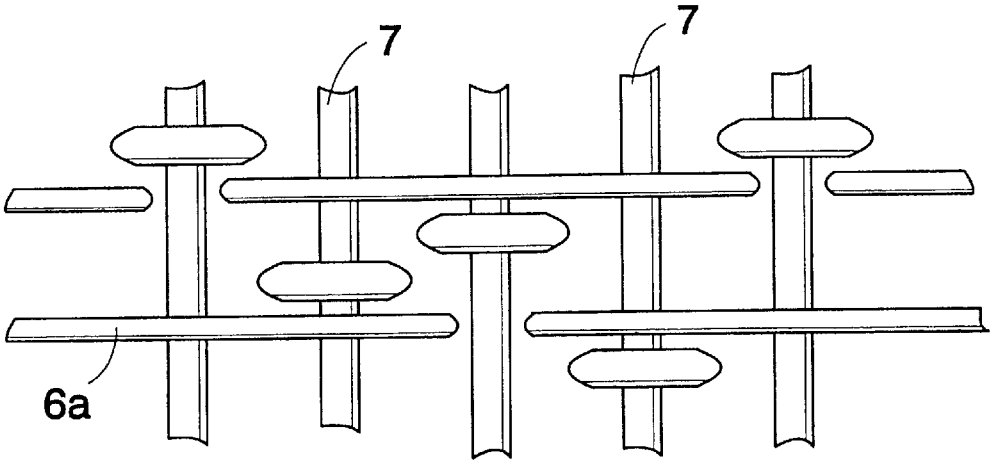
Figure 4A:
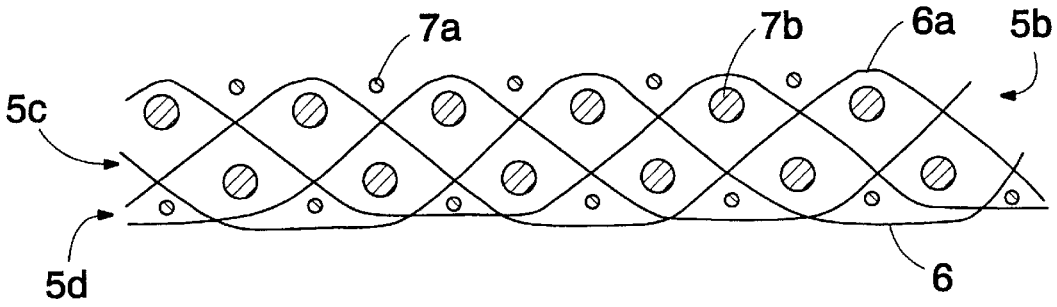
Figure 4B:
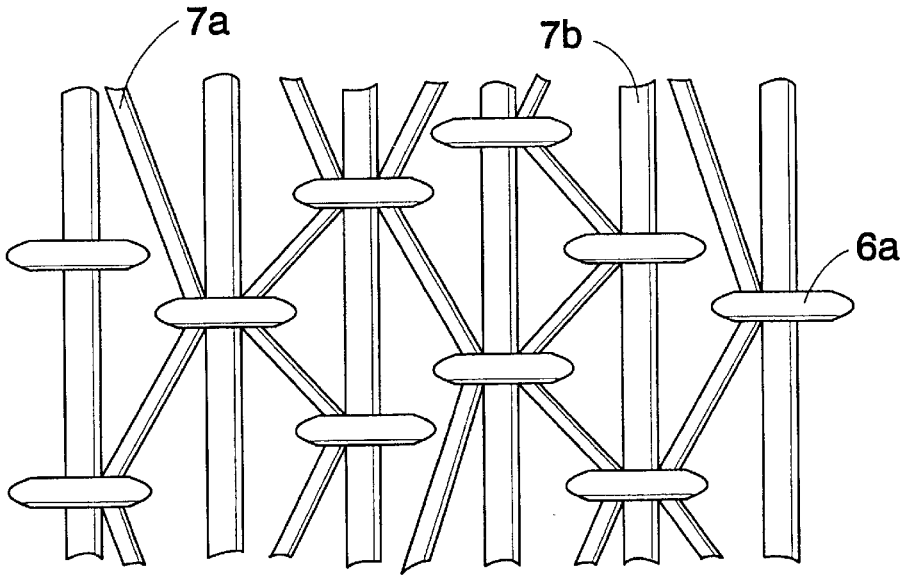
Figure 5:
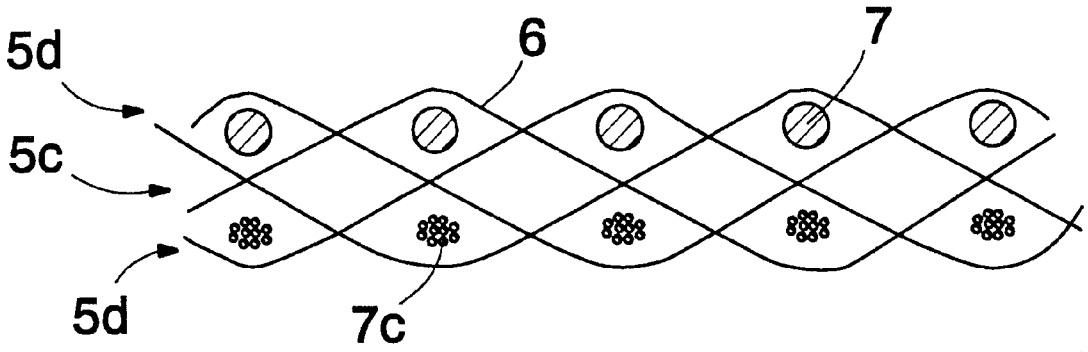

The invention will be described in greater detail in the accompanying drawings, in which FIG. 1 is a schematic side view of a band dryer unit wherein an arrangement according to the invention can be applied, FIG. 2 is a schematic sectional view of an arrangement according to the invention, viewed transversely with respect to the direction of travel of the web, FIG. 3*a* is a schematic sectional view of another arrangement according to the invention applied in connection with a band dryer and also viewed transversely with respect to the direction of travel of the web, FIG. 3*b* shows schematically a coarse wire of FIG. 3*a* from another angle, FIGS. 4*a* and 4*b* show a possible structure of a coarse wire, and FIG. 5 is a sectional view of yet another structure of a coarse wire according to the invention.

FIG. 1 shows, in a simplified manner, a band dryer known per se, in connection of which the arrangement according to the invention is to be used. The structure and operating principle of the band dryer 1 are already described above in the description of the background art, which will now be referred to. A fibre web 4 to be dried is supplied between a heated upper band 2 and a cooled lower band 3 in a direction of travel A denoted in the figure, together with wires 5*a* and 5*b* supporting the web which are passed together through the dryer. The wires may consist of a woven paper machine fabric with one or more layers, and they are usually bands in the shape of an endless loop, made to travel around different rolls or the like, and they are controlled by the rolls. In the case shown in the figure, there are two wires between the web and the cold band, but at least in principle it is possible to use even a greater number of separate wires. The fabric placed against the web 4 to be dried, shown uppermost in the figure, is a fine wire 5*a* and the lower fabric is a coarse wire 5*b* which comprises a coarse-textured section 5*c* placed against the fine wire 5*a* and a section with a fine texture 5*d* placed against the cooled band 3. Such a structure of the coarse wire 5*b* is shown more clearly below in FIG. 2. It is generally required that a coarse wire has a sufficient water retention capacity so that it is capable of transporting the liquid that is separated from the fibre web 4 with the band dryer 1 from between the upper and the lower band 2 and 3. The water retention capacity can be adjusted by means of the thickness of the coarse wire and the textural structure. Material for the threads of the coarse wire can be any suitable plastic material that withstands hydrolysis. Advantageous plastic materials include polyethylene terephthalate (PET), polyamide (PA), polyphenylene sulphide (PPS), polyetheretherketone (PEEK), polydimethylene cyclohexylene terephthalate (PCTA) and polyethylene naphthalate (PEN). FIG. 2 shows, in a very simplified manner, a cross-section of an arrangement according to the invention viewed transversely to the direction of travel of the web. The fabric supporting the web consists of a fine wire 5*a* placed against the web 4 and a separate coarse wire 5*b*. It should be mentioned that the different textural sections are shown separately from one another for the sake of clarity in FIG. 2 as well as in FIG. 3 below. In actual use, the web to be dried between the metal bands is naturally pressed tightly together with the wires. The coarse wire 5*b* comprises a coarse-textured section 5*c* facing the fine wire 5*a*, and steam that evaporates from the web is able to pass easily via the larger and more numerous openings thereof through the coarse structure of the wire. The transfer of humidity is thus effective. Contrary to what was believed before, the coarse texture of the coarse wire on the side of the web does not always cause significant marking in the web through the fine wire, especially if a slightly thicker fine wire is used than previously and/or if the structure of the fine wire is made more rigid so that it does not press into depressions provided on the surface of the coarse side of the coarse wire. Therefore the surface of the coarse wire facing the fine wire does not necessarily have to have a fine texture or to be otherwise especially smooth and even. Further, according to the inventive idea the section of the coarse wire facing the metal band is formed of a fine texture with a suitable thickness. The fine-textured section of the coarse wire has preferably such a layer thickness that its water retention capacity is sufficient to retain the amount of water separated from the web so that the water is not able to move back to the web at any stage but it can be removed from between the metal bands by the coarse wire. The part of the coarse wire facing the metal band is thus made of a fine texture with smaller openings. The openings in the fine-textured section of the coarse wire are placed against the substantially even metal band, so that condensing humidity can be retained on the surface of the coarse wire against the metal band by means of capillary forces, wherefore the web will not get wet again. For the sake of illustration, the figure shows a possible textural structure of the coarse wire comprising warp threads 6 in the machine direction, transverse weft threads 7 and filling threads 8. It is clear that textural structures formed of other kinds of threads and bindings between them are possible.

FIG. 3*a* is a simplified cross-sectional view of another possible structure of the arrangement. As in the previous figure, the coarse wire 5*b* comprises a fine-textured section 5*d* against the cooled metal band and a coarse-textured section 5*c* against the fine-textured section. The difference compared to the asymmetrical structure shown in the previous figure is that in FIG. 3*a* both surfaces of the coarse wire 5*b* in the direction of travel comprise fine-textured sections 5*d*. Both the surface against the fine wire 5*a* and the surface against the cooled metal band 3 consist of a fine texture 5*d*. The humidity arriving from the web 4 is still in the form of steam at the surface of the coarse wire 5*b* facing the web, and it penetrates easily the dense surface of the coarse wire, which, however, simultaneously prevents the flow of liquid in the opposite direction. Further, the structure of the coarse wire may be substantially symmetrical with respect to the central axis of the wire as shown in the figure, but this is not necessary in any way since, for example, the thicknesses, binding types and threads to be used in the fine-textured sections 5*d* can be selected in view of the properties required of the wire. A detail of the structure of the coarse wire is shown further in FIG. 3*b* viewed from the direction of the fine wire.

FIG. 4*a* is a cross-sectional view of a structure of a possible coarse wire according to the invention. The same structure is shown partly in FIG. 4*b*, viewed from the side of the fine wire.

FIG. 5 shows a structure of yet another coarse wire that can be used in the arrangement according to the invention. As shown in the figure, the coarse-textured section 5*c* in the middle of the wire has an extremely loose structure since it does not comprise any transverse weft threads. The fine-textured section 5*d* of the wire facing the metal band is formed by means of spun weft threads 7*c* in the case shown in the figure. It is possible to form a dense fine texture on the side facing the metal band by also using oval, flat or thinner weft threads.

In connection with the coarse wire according to the invention described above especially in FIG. 1 and in the description thereof, it is preferable to use a fine wire comprising three interwoven layers: a surface facing the web, a bottom facing the coarse wire and a middle section situated between them. The density of the surface and the bottom is greater than that of the middle section. The close structure provided by means of the threads on the surface of the fine wire reduces marking, since a dense structure has more contact points between which the contact pressure can be distributed. The dense surface simultaneously prevents rewetting. Further, the surface is preferably made such that the warp threads in the machine direction are partly sheltered by the rest of the structure so that they are not worn so easily on the side of the paper, wherefore the risk of a wire break occurring in the prior art fine wires can be prevented more effectively. In such a structure, the compression acting on the wire is advantageously directed more towards the transverse threads than the threads in the machine direction. Further, the middle section, which is made of a looser texture than the surface and the bottom, improves the transverse stability and bending stiffness of the fine wire. The middle section also makes the wire slightly thicker than normally and provides the fine wire with strength. When designing the thickness of the middle section, it should be taken into account that the wire does not transport too much air between the metal bands and that it can be dried sufficiently before it is passed between the metal bands. On the other hand, if the fabric can be made sufficiently stiff, the middle section and thus also the entire fine wire may be rather thin. The bottom is made dense, even and suitably stiff so that the wire cannot press into the uneven spots in the coarse texture of the coarse wire. The middle section providing strength also prevents the aforementioned pressing of the fine wire and thus the marking. Furthermore, the smooth bottom prevents the wearing of the contact surfaces of the coarse wire and the fine wire. One alternative is to form the fine wire at least partly of metal. In a preferred embodiment, the warp threads of the wire are made of metal and the weft threads are made of a suitable plastic material that withstands hydrolysis, for example PES, PA, PPS, PEEK, PCTA or PEN. A wire fabric consisting entirely of metal threads is also possible.

It is further mentioned that the behaviour of the wires in the drying section and their dewatering properties can be controlled by adjusting the hydrophobicity and/or hydrophilicity of the different wire layers in a desired manner. A wire may be either entirely hydrophobic or correspondingly entirely hydrophilic. Further, a wire can be provided with hydrophobic and/or hydrophilic sections for example only in desired predetermined layers thereof. Increasing the hydrophobicity or hydrophilicity of a wire or a certain layer thereof makes it easier to clean the wire and to keep it clean and improves the dewatering properties of the wire. Dirt-repellent compounds forming a film usually greatly reduce the surface energy and are hydrophobic, but they may also be hydrophilic. A hydrophobic part usually consists of a hydrocarbon chain (CH2)n or an aromatic cyclic compound. Hydrophobic compounds also include silicone-based or fluorine-based polymers and mixtures thereof. Further, polyester thread, which is greatly used as a material for wires, is rather hydrophobic as such and does not therefore absorb water. Hydrophobic polymers also often have low surface energy, which increases their ability to repel dirt and facilitates the cleaning of wires. An example of such a fluorine compound is polytetrafluoroethylene (PTFE), which is known by the trade name Teflon®. The surface energy of PTFE is only 18 $mJ/m^2$. There are several manners of providing a wire with a hydrophobic structure. Hydrophobicity can be achieved, for example, by treating the finished wire or a certain layer thereof through spraying or soaking, for instance, or by using hydrophobic threads in desired parts of the wire structure, thus making a certain layer of the wire hydrophobic. A hydrophobic thread can be produced by making the thread from a hydrophobic material, such as PTFE, by coating a thread made of a material used in the manufacture of wires with a hydrophobic cover, or by mixing a hydrophobic polymer with a thread material commonly used for wires. The threads can naturally also be treated, for example, by spraying or soaking with a hydrophobic polymer or a polymer mixture. Correspondingly, examples of hydrophilic groups in an aqueous solution include —COOH, —OH, —NH2, —O—, —CONH—, —COO—, —SO3, —OSO3 and —N+(CH3)3. It can be mentioned as an example that a polyamide thread used widely in paper machine fabrics is rather hygroscopic as such, since it is able to absorb quite a high percentage of water. Due to its character, polyamide has also hydrophilic properties. Furthermore, the hydrophilicity of a polyester thread can be increased similarly as its hydrophobicity. On the other hand, mixing a hydrophilic component with a polyester polymer is not considered a very good solution since the absorption of water into the inner structures of the thread thus becomes easier, wherefore the risk of hydrolysis increases. The most advantageous manner of increasing hydrophilicity of a thread is probably surface treatment with a hydrophilic component. Adding hydrophilic groups to the surface of a polyester can also be implemented by grafting, wherein the hydrophilic groups are made to adhere to the surface of the polyester through irradiation, for example.

The drawings and the related description are only intended to illustrate the inventive idea. The details of the invention may vary within the scope of the claims. Therefore, a coarse wire may comprise more textural layers than disclosed above. The essential feature of the invention is, however, that a fine texture is placed against a cooled metal band and on the other side of the fine texture there is a coarse texture with good permeability. Further, the properties disclosed above in the specification can also be provided in the wire by means of structures other than those made by weaving. It should also be mentioned that it is obvious for a person skilled in the art to apply, for example, different bindings, thread materials and threads with different cross-sections to manufacture wires of the arrangement according to the invention. It should also be mentioned that several band dryer units described above may be placed in succession, and that the successive units may be placed alternately in different positions with respect to the wire. Yet, the present invention can be applied therein.

What is claimed is:

1. An arrangement for a drying section of a paper machine, the arrangement comprising a fine wire and a coarse wire which are formed of several threads and withstand high temperatures and humidity, the wires being arranged to pass through the drying section between a heated and a cooled metal band provided in the drying section, together with a fibre web placed against the heated band, such that the fine wire is arranged against the web to be dried and the coarse wire is arranged against the cooled metal band, and the side of the coarse wire to be placed against the cooled metal band has a fine texture, and a coarse-textured section of the coarse wire is placed against said fine-textured section.

2. An arrangement according to claim 1, wherein the coarse wire comprises a fine-textured section both on the side of the cooled metal band and on the side of the fine wire, and between these fine-textured sections there is a coarse-textured section.

3. An arrangement according to claim 2, wherein the structure of the coarse wire is substantially symmetrical with respect to the central axis thereof.

4. An arrangement according to claim 1, wherein the fine wire comprises three interwoven layers, wherein the surface layers placed against the web and the coarse wire are denser than the middle section between them.

5. An arrangement according to claim 1, wherein the fine wire is at least partly made of metal threads.

* * * * *